United States Patent [19]

Goodridge

[11] 4,053,661

[45] * Oct. 11, 1977

[54] PARTICLE CLOUD COATING METHOD AND APPARATUS

[75] Inventor: William C. Goodridge, Branford, Conn.

[73] Assignee: Electrostatic Equipment Corporation, New Haven, Conn.

[ * ] Notice: The portion of the term of this patent subsequent to Oct. 21, 1992, has been disclaimed.

[21] Appl. No.: 653,468

[22] Filed: Jan. 29, 1976

Related U.S. Application Data

[60] Division of Ser. No. 454,566, March 25, 1974, Pat. No. 3,937,179, which is a continuation-in-part of Ser. No. 254,472, May 18, 1972, Pat. No. 3,828,729.

[51] Int. Cl.[2] ..... B05B 15/04; B05C 11/06; B05D 1/24

[52] U.S. Cl. ..... 427/185; 118/DIG. 5; 427/195

[58] Field of Search ..... 427/21, 33, 27, 185, 427/195; 118/301, 310, DIG. 5

[56] References Cited

U.S. PATENT DOCUMENTS

| | | | |
|---|---|---|---|
| 3,167,454 | 1/1965 | Tompson | 118/425 |
| 3,248,253 | 4/1966 | Barford et al. | 118/DIG. 5 |
| 3,624,232 | 11/1971 | van Dorp et al. | 427/195 |
| 3,670,699 | 6/1972 | Sargent | 427/185 |
| 3,695,909 | 10/1972 | Fabre et al. | 118/DIG. 5 |
| 3,799,112 | 3/1974 | Huteaux | 118/DIG. 5 |
| 3,817,211 | 6/1974 | Brown et al. | 118/630 |
| 3,914,461 | 10/1975 | Goodridge | 427/33 |

*Primary Examiner*—Ronald H. Smith
*Assistant Examiner*—Shrive P. Beck

[57] ABSTRACT

Objects are coated using apparatus which includes a mechanical barrier effectively interposed between a cloud of particles which is produced thereby, and the travel path for objects conveyed therethrough. The barrier means includes an upstanding baffle having an edge portion configured to progressively expose different vertical portions of the object as it is conveyed thereby. Generally, at the beginning of the travel path the lower portions of the objects will be masked by the baffle so as to promote deposition of the particles upon the upper surfaces initially. As it proceeds along the travel path, progressive exposure of the lower portions of the object will permit the complete and uniform coating thereof.

5 Claims, 8 Drawing Figures

PARTICLE CLOUD COATING METHOD AND APPARATUS

REFERENCE TO RELATED APPLICATION

This is a division of application Ser. No. 454,566 filed Mar. 25, 1974 now U.S. Pat. No. 3,937,179 which is a Continuation-in-part of copending application for Letters Patent Ser. No. 254,472, filed May 18, 1972 now U.S. Pat. No. 3,828,729.

BACKGROUND OF THE INVENTION

Apparatus and techniques have been disclosed in the prior art by which coatings can be produced upon a variety of objects, by exposing them to a cloud of solid particles. Such a cloud may be generated by charging air upwardly through a bed thereof, as in conventional fluidized bed equipment, or by the use of spray systems and the like. Depending upon the nature of the particulate material employed, adhesion to the object may be promoted by preheating, adhesive precoating, or by other means, and a variety of techniques can be used to convert the particles unto a unified, continuous coating, again depending upon the characteristics of the coating material employed.

Although many different types of objects (such as continuous lengths of wire, tubing, and the like, as well as individual objects which may be passed into or adjacent the cloud of particles) may be coated in such a manner, difficulties are encountered in attempting to produce uniform coatings upon objects having vertical dimensions in excess of a certain value. This is due largely to the rarefaction that occurs in the upper regions of the cloud, which produces a vertical gradient of particle concentration, thereby causing objects which have surfaces at substantially different heights to acquire heavy deposits upon their lower portions, while developing progressively thinner coatings on the upper surfaces. These effects may be most pronounced when the particle cloud is produced in fluidized bed equipment, and especially when fusion is relied upon for adherence of the particles; in the latter event, the preexistence of coating material on the surface of the object does not effectively limit the thickness of the deposit ultimately produced, as is the case when, for example, adhesion is electrostatically induced.

Accordingly, it is the principal object of the present invention to provide a novel apparatus and system in which articles having a significant vertical dimension may be uniformly coated with particles from a cloud thereof.

It is also an object of the invention to provide such an apparatus and system which are highly efficient, safe, and convenient to operate, and which are at the same time relatively simple and inexpensive to produce.

Another object is to provide a novel method by which an object of significant vertical dimensions may be uniformly coated by exposure to a cloud of particles.

SUMMARY OF THE DISCLOSURE

It has now been found that certain of the foregoing and related objects of the invention are readily attained in apparatus for coating an object, which comprises, in combination, means for producing a cloud of particles, means for conveying at least the portion of the object to be coated along a travel path laterally adjacent the cloud-producing means, and mechanical barrier means including at least a first generally upstanding baffle effectively interposed laterally between the cloud-producing means and the travel path. The baffle has an elongated edge portion across which particles may readily pass from the cloud-producing means to the travel path, and the conveyor means and baffle are so disposed, relative to one another, that the travel path traverses the imaginary, laterally-extending projection surface of the edge portion of the baffle at a non-perpendicular angle thereto. Particles of the cloud are thereby permitted to deposit upon the object, causing a coating to develop, along an axis that is angularly displaced from the axis of the travel path, as progressively lower vertical portions of the object horizontally register with the edge portion and thereby become exposed behind the baffle, during passage of the object thereby.

In the preferred embodiments of the invention, the cloud-producing means is provided by fluidized bed means and the edge portion of the baffle is generally rectiliner, with the defined projection surface constituting the laterally-extending plane thereof. The edge portion may slope downwardly in the forward direction of the travel path, with the travel path being substantially horizontal, or the edge portion may be subsantially horizontal, with the travel path being disposed at an angle thereto. In certain instances, the edge portion of the baffle will have a complex configuration consisting of a plurality of recitilinear elements that are angularly disposed with respect to one another. Although the baffle will generally have a free upper edge providing the defined edge portion, it may be provided by an elongated slot in the baffle extending generally in the direction of the travel path. Desirably, the barrier means includes a second upstanding baffle configured similarly to the first baffle, and which is spaced laterally therefrom to the opposite side of the travel path. In such a case, the first and second baffles should be generally transversely aligned, with the travel path disposed therebetween so as to permit simultaneous coating of two sides of the object conveyed therealong, and the travel path and baffles will generally be substantially rectilinear and parallel to one another. The conveying means will usually include means for mounting a multiplicity of elongated objects thereon, with their axes vertically disposed, for sequential passage along the travel path, and such mounting means will desirably be adapted to rotate each of the objects about a vertical axis.

The apparatus of the invention may comprise a system for coating a multiplicity of objects transported sequentially along a predetermined path, which system includes a fluidized bed unit comprising a substantially closed container having a passageway for transport therethrough of objects depending thereinto, and at least a first plenum chamber extending along one side of the passageway and having an inlet for pressurized air and an upwardly directed opening. The unit also includes a porous plate spanning the opening, and a baffle interposed between the plenum chamber and the passageway. The baffle has an elongated upper edge portion spaced above the porous plate and so disposed that the passageway traverses the imaginary, laterally-extending projection surface of the edge portion, at a non-perpendicular angle thereto. Accordingly, a cloud of particles of a coating material may be generated above the porous plate of the plenum chamber; the particles may readily be deposited upon progressively lower vertical portions of objects as such portions horizontally register with the edge portion and are thereby exposed behind the baffle, during passage along the passageway.

Preferably, in such a system the container of the fluidized bed unit has a second plenum chamber substantially identical to the first-mentioned plenum chamber and extending along the opposite side of the passageway. The unit will additionally include a second porous plate spanning the opening of the second chamber, as well as a second barrier, of substantially identical configuration to the first-mentioned barrier, interposed between the second plenum chamber and the passageway. The unit will thereby be adapted to simultaneously coat opposite sides of objects passed along the passageway, with particles from clouds generated over both of the first and second plenum chambers. The container may have a pair of upstanding parallel interior walls defining, in part, the first and second plenum chambers and the passageway therebetween, and the first and second baffles may be mounted for vertical adjustment upon such interior walls.

Certain objects of the invention are readily attained in a method for coating an object which comprises the steps of: generating a cloud of particles adjacent one side of a generally upstanding baffle having an elongated edge portion permitting ready passage thereacross of said particles from said cloud, and passing at least an axial portion of an object to be coated laterally adjacent the other side of the baffle along a predetermined travel path. The travel path traverses the imaginary, laterally-extending projection surface of the edge portion at a non-perpendicular angle thereto, so that the baffle initially blocks from contact, by the particles, at least the axial portion of the object, and causes exposure of progressively lower vertical portions thereof during passage along the travel path. As a result, a coating is developed on the axial portion of the object along an axis that is angularly displaced from the axis of the travel path.

In practicing the method, a multiplicity of objects will generally be sequentially passed along the travel path for coating, and the travel path may extend between two of such baffles, adjacent the outer side of each of which a cloud of particles may be generated to simultaneously effect particle contact upon opposite sides of the object during passage therealong. Preferably, the particles will be of a heat-fusible material, and the method will include the additional step of heating the object, prior to deposition of particles thereon, at least to the fusion temperature of the particles, so as to promote adhesion thereof. It may also include the additional step of heating the object at least to the fusion temperature of the particles subsequent to their deposition thereon, so as to produce a fused coating thereof upon the object.

DETAILED DESCRIPTION OF THE ILLUSTRATED EMBODIMENTS

Figure 1:
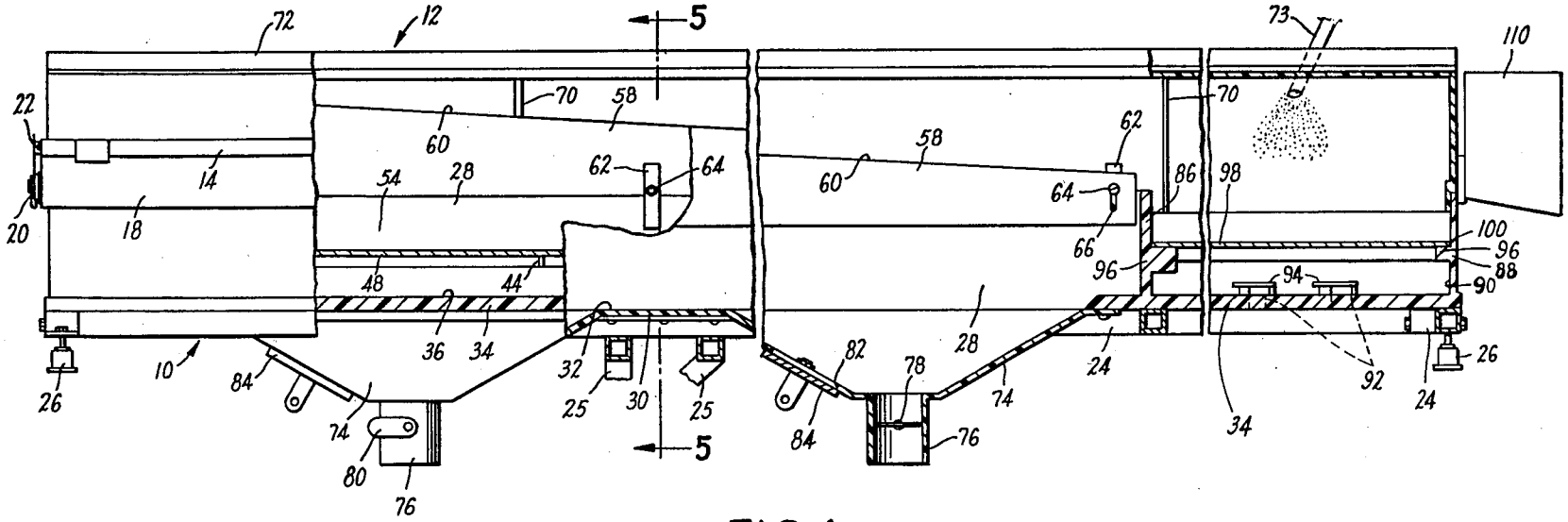
FIG. 1 is a fragmentary side elevational view in partial section of apparatus embodying the present invention.
Figure 3:
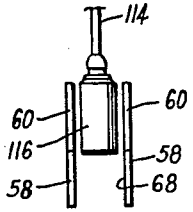
FIG. 3 is a right end view of the parts of the apparatus illustrated in FIG. 2 and drawn to a scale slightly enlarged therefrom.

Turning now in detail to FIGS. 1- 6 of the appended drawings, therein illustrated is apparatus embodying the present invention and including a fluidized bed unit comprised of a bed base and a cover therefor, generally designated by the numerals 10, 12 respectively. The cover 12 has a peripheral flange 14 with a downwardly opening channel 16 in which is received the upper edge of the sidewall 18 of the base 10. A number of hook lock 20 are spaced about the opening of the base 10, and cooperate with corresponding studs 22 on the flange 14 to lock the cover 12 thereto. The tubular elements 24, which provide a frame bed for the base 10, rest upon substructure elements 25; the fluidized bed unit is connected to the chassis by anti-vibration members 26, and means (not shown) is provided to vibrate the unit with the member 26 serving to prevent transmission of motion therefrom to the substructure.

Figure 5:
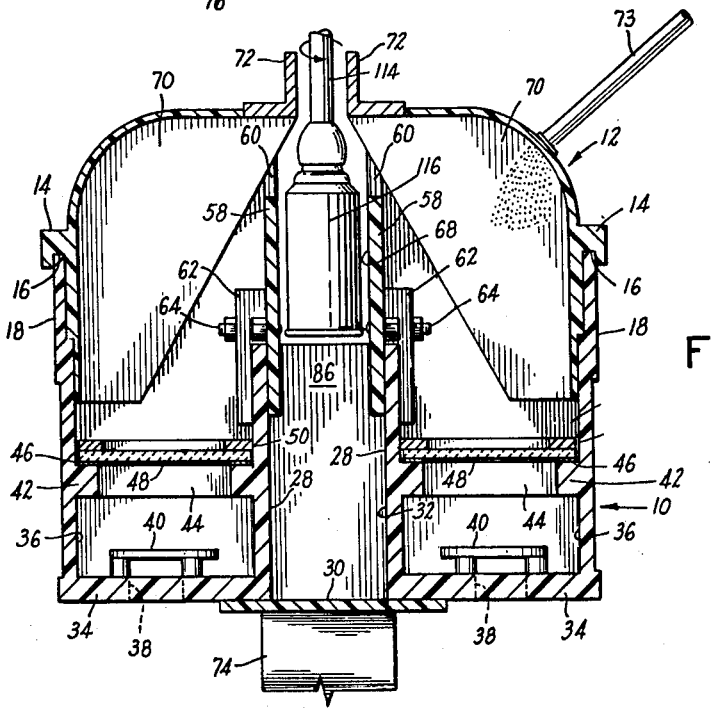
FIG. 5 is a section view along line 5—5 in FIG. 1, drawn to the scale of FIG. 4.

As may best be seen in FIG. 5, the base 10 includes a pair of parallel upstanding interior walls 28 which cooperate with a base plate 30 to define a central trough 32 running along most of the length of the unit. The walls 28 also cooperate with the bottom walls 34 to define two elongated lateral plenum chambers 36, which are coextensive with the trough 32 and lie on opposite sides thereof. Air inlet ports 38 extend through the bottom walls 34 and have diffusion plates 40 positioned thereover, the latter serving to promote distribution along the length of the chambers 36 of air injected through the ports 38.

A peripheral flange 42 extends about each of the chambers 36 to provide support for a chamber-spanning porous plate 48 which is spaced thereon above the bottom wall 34. Interposed between the flanges 42 and the plates 48 are thin layers 46 of gasket material, and strut elements 44 extend across the flanges 42 to strengthen the base 10 and to provide additional support for the plates 48. The rectangular frames 50 secure the porous plates 48, such as by flat-headed screws engaged therethrough.

An elongated baffle 58 is secured to each of the interior walls 28 by cooperating clamps 62, which are tightened thereagainst by the nut and bolt fasteners 64 which pass through the walls 28 and through the elongated slots 66 in the baffles 58. As will be appreciated, the slots 66 enable adjustment of the height as well as the angular attitude of the baffles 58 with respect to the interior walls 28. Each of the baffles 58 has an upper edge 60 which slopes downwardly toward the outlet end of the unit, i.e., in a downstream direction; the edges are in substantially horizontal alignment and the baffles 58 are parallel, to thereby define a passageway 68 of uniform width along the full length of the baffles 58.

The cover 12 has a number of spaced reinforcing webs 70, and upstanding flanges 72 which extend along its entire length on either side of the passageway 68. The flanges 72 cooperate with an enclosure or cowling (not illustrated) which substantially surrounds the unit and has marginal edges abutting against the flanges 72, to prevent the entry of powder or debris thereinto. A feed conduit 73 is attached to the cover 12 to provide means for furnishing powder to the unit from a reservoir or supply thereof (not shown), and means (also not shown) may be present within the unit for detecting the quantity of powder therein, to automatically control the feed operation on a continuous basis. The bottom of the unit is furnished with two hoppers 74, which communicate with the central trough 32 and have conduits 76 extending downwardly therefrom. The conduits 76 are hooked into a vacuum system (not shown) to enable the withdrawal of excess powder which would otherwise tend to accumulate in the trough 32, and the butterfly disk 78 and operating mechanism 80 therefor, which are provided on each conduit 76, control the vacuum effect. Each hopper 74 has a cleanout opening 82 that is normally closed by a cover assembly 84, the principal purpose of which is to permit the ready removal of the articles, which may fall into the trough 32 from time-to-time during the coating operation.

Figure 6:
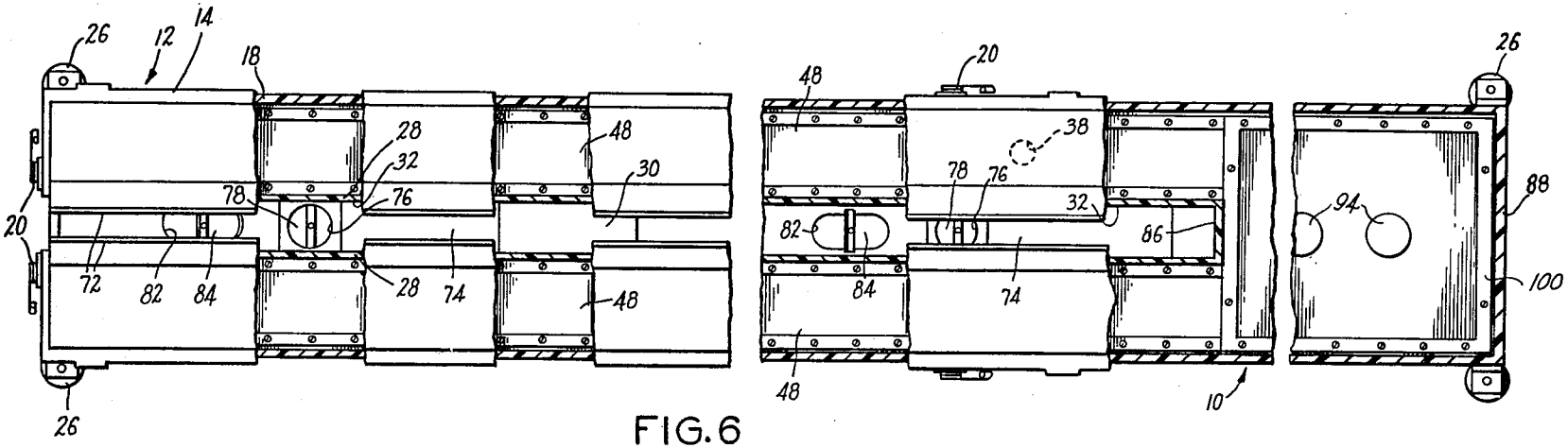
FIG. 6 is a fragmentary plan view in partial section of the apparatus of FIG. 1.

As is most readily seen in FIGS. 1 and 6, a narrow end wall 86 lies transversely between the interior walls 28 adjacent the outer ends thereof and defines, in cooperation with the outer end wall 88 of the unit, a plenum chamber 90 extending across the width thereof. As in the case of the elongated plenum chambers 36, the plenum chamber 90 is provided with inlet ports 92 and diffusion plates 94 for the injection and distribution of air, and the peripheral flange 96, which projects inwardly from about the chamber 90, supports a porous plate 98, a peripheral frame 100, and a frame 104.

Adjacent the outlet end of the unit and in communication with the passageway 86 is a channel extension 110, which serves to enable the controlled release of powder that may become trapped between adjacent articles, vacuum means being attached to the extension 110 for that purpose, if so desired. As suggested in FIGS. 2 and 3, a conveyor 112 is disposed above the unit and has a multiplicity of mounting hangers 114 depending therefrom, each supporting a can 116 thereon for coating. The conveyor may be of any conventional design, and the hangers may have magnetic coupling elements on the ends thereof to support the cans; of course, when different articles are to be coated in the unit, other support means may be more suitable.

Figure 2:
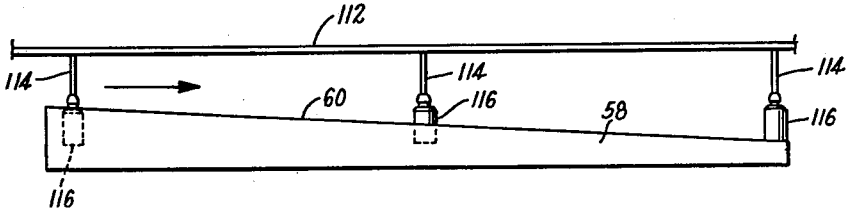
FIG. 2 is a diagrammatical side elevational view of the conveyor and the exposed one of the pair of baffles employed in the apparatus of FIG. 1, drawn to a reduced scale and showing a number of cans being transported for coating.
Figure 4:
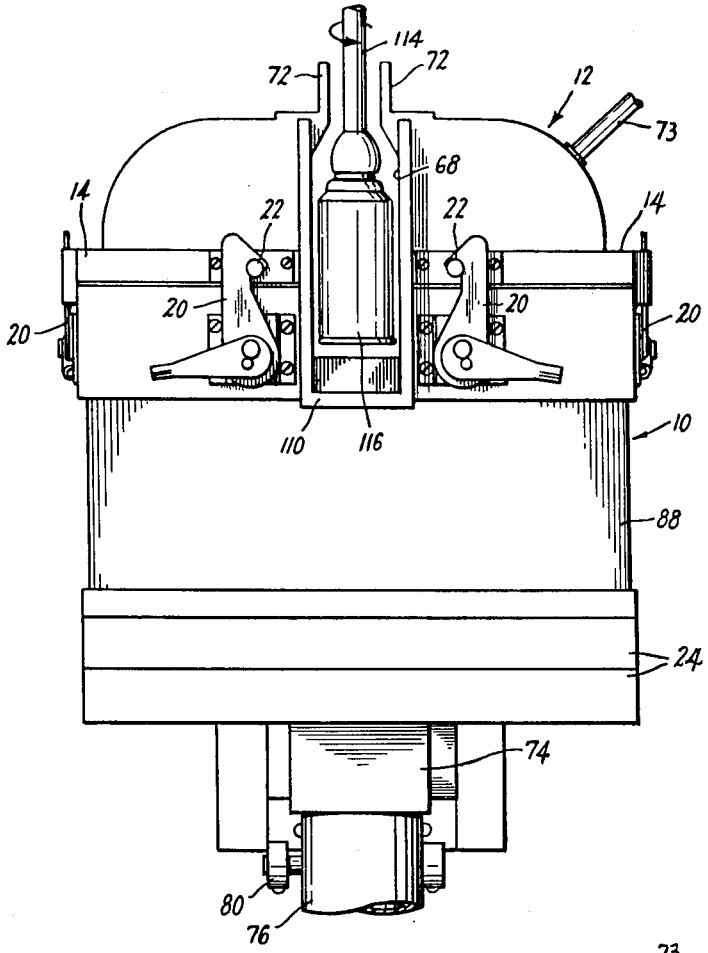
FIG. 4 is a right end elevational view of the apparatus of FIG. 1 drawn to an enlarged scale.

As the arrow in FIG. 2 indicates, the conveyor 112 transports the cans 116 from left to right along a horizontal path through the passageway 68. Initially, the cans 116 are substantially entirely blocked or masked by the baffles 58. However, due to the slope of the upper edges 60, as the cans 116 proceed downstream progressively lower surface portions become horizontally aligned with the edges 60 and thereby exposed for powder contact behind the baffles 58.

Since as previously has been pointed out, the lower portions of the cans 116 or other depending objects are most readily coated, considerably lower particle concentrations and cloud heights are necessary to produce a satisfactory deposit thereon. The plenum chamber 90 and the porous associated therewith (which constitute a substantially independent cloud chamber) may therefore be used to effectively coat the can bottom walls, with the air flow rate thereinto being diminished appreciably, as compared to that maintained throughout the remainder of the unit. As will be apparent, the cans 116 proceed on the conveyor 112 downstream through the passageway 68 between the baffles 58, and outwardly from the unit through the extension 110. They may then pass through sequential excess powder removal, heating and cooling stages, and preheating effects, adhesive coating stations, etc., ahead of the fluidized bed unit may also be provided.

Figure 7:
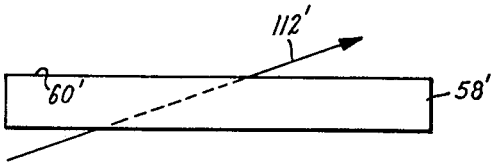
FIG. 7 is a side elevational diagrammatical view of a different baffle and conveyor arrangement suitable for use in the apparatus of the invention.

Although a preferred embodiment of the invention has been illustrated and described hereinbefore, it will be evident that many variations can be made in the apparatus without departure from the novel concept of the invention. One such alternative is depicted in FIG. 7 wherein a simple modification of the arrangement of the conveyor and baffles employed in the unit is shown. Thus, the baffle 58' is sustantially the same as baffle 58 of the preceding figures, but has a free upper edge 60' which is substantially horizontally disposed. the conveyor 112' is comparable to the previously-described conveyor 112 but, rather than extending horizontally, it is slightly inclined. As a result, objects depending from the conveyor 112' are progressively exposed behind the baffle 58', with virtually the same coating effect as is produced by the apparatus of the previous embodiment. However, the embodiment of FIG. 7 affords the advantage of enabling the coating of objects of increased axial length in a direction generally perpendicular to the fluidized bed (extended dimensions parallel to the bed, of course, presenting little difficulty). Because of the edge 60' is a uniform distance above the porous plate (not illustrated, but horizontally disposed therebelow), and the objects pass from a position lower than the plate location, the axial length that can be coated is not limited by the upper extent of the bed, i.e., by the height to which the particles are elevated. As will be noted, this is not true of the apparatus of FIG. 1–6 due to the parallel disposition of the travel path of the cans 116 and the plate 48; in such apparatus, it will not be feasible to coat objects that extend above the upper limits of the cloud.

Figure 8:
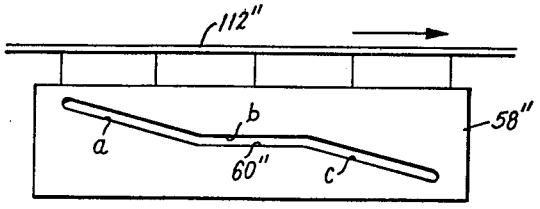
FIG. 8 is a view similar to FIG. 7 showing another type of baffle suitable for use herein.

A second modification of the apparatus is shown in FIG. 8 wherein, rather than utilizing a free upper edge of the baffle to provide the edge portion across which the particles must pass, the baffle 58" has a complex slot 60" consisting of three rectilinear elements "*a*", "*b*", "*c*", extending therein in the general direction of the travel path. The baffle 58" cooperates with the conveyor 112" to progressively expose lower portions of objects depending therefrom, as they travel in the direction indicated by the arrow. It will be noted that the central element "*b*" of the slot 60" is substantially horizontal, as a result of which no fresh surfaces of the objects will be exposed during passage thereby. An exposure of extended duration will thereby be afforded, as may be desirable in coating an object having a central portion which is somewhat inaccessible or on which a heavier coating is desired. From this simple illustration, it will be appreciated that many variations in the configuration of the edge portion are possible, to achieve a wide variety of coating effects; it should also be clear that, although continuous rectilinear edge portions have been illustrated, in some instances it may be desirable to utilize discontinuous edges or curvilinear portions to achieve the deposits desired.

Other variations in the apparatus are of course possible, and include the provision of different arrangements and greater or lesser numbers of plenum chambers, etc., to generated different cloud chamber effects and to expose the objects to different conditions during passage along the travel path. Although not specifically discussed heretofore, it will be appreciated that a single-effect fluidized bed may be employed, with the objects passing behind only one baffle interposed therebetween.

The materials of construction will be equally obvious to those skilled in the art, and need not be discussed in detail. Moreover, virtually any powder or other dry particulate or finely-divided coating material may be employed to provide the particle cloud, in accordance with the present invention. For example, synthetic resins such as polyvinyl chloride, polypropylene, epoxies, acrylics, polyesters, etc. may all be used successfully in accordance herewith. Inorganic materials such as talc, phosphors, elemental metals, salts, and the like may also be used, as may materials in fibrous form, such as asbestos, glass, the typical flocs, etc. Among the myriad uses for the type of apparatus illustrated, the coating of aerosol and food and liquid packaging cans, glass containers, tanks for fire extinguishers and gas storage, transformer housings, and boxes of various types and configurations might be mentioned as exemplary.

Thus, it can be seen that the present invention provides a novel apparatus and system in which articles having a significant vertical dimension may be uniformly coated with particles from a cloud thereof. The apparatus and system are highly efficient, safe, and convenient to operate and are, at the same time, relatively simple and inexpensive to produce. The invention also provides a novel method by which an object of significant vertical dimensions may be uniformly coated by exposure to a cloud of particles.

Having thus described the invention, I claim:

1. In a method for coating an object, the steps comprising: generating a cloud of particles adjacent one side of a generally upstanding baffle having an elongated edge portion permitting ready passage thereacross of said particles from said cloud, and passing at least an axial portion of an object to be coated laterally adjacent the other side of said baffle along a predetermined travel path which traverses the imaginary, laterally-extending projection surface of said edge portion at a non-perpendicular angle thereto, said baffle initially blocking from contact by said particles at least said axial portion of the object, and causing exposure of progressively lower vertical portions thereof for contact by said particles during passage of the object along said travel path thereby, so as to develop a coating on said axial portion along an axis that is angularly displaced from the axis of said travel path.

2. The method of claim 1 wherein a multiplicity of objects are sequentially passed along said travel path for coating.

3. The method of claim 1 wherein said travel path extends between two of said baffles, and wherein a cloud of particles is generated adjacent the outer side of each of the baffles to simultaneously effect particle contact upon opposite sides of the object during passage therealong.

4. The method of claim 1 wherein said particles are of a heat-fusible material, and including the additional step of heating the object, prior to deposition of particles thereon, at least to the fusion temperature of said particles, so as to promote adhesion thereof.

5. The method of claim 4 including the additional step of heating the object at least to said fusion temperature subsequent to deposition of particles thereon, so as to produce a fused coating thereof upon the object.

* * * * *